US012790752B2

(12) United States Patent
Matsuda et al.

(10) Patent No.: US 12,790,752 B2
(45) Date of Patent: Nov. 10, 2026

(54) PAPERMAKING MAT AND METHOD FOR PRODUCING PAPER MAKING MAT

(71) Applicant: IBIDEN CO., LTD., Ogaki (JP)

(72) Inventors: Wataru Matsuda, Takahama (JP); Tomohisa Yamazaki, Takahama (JP); Toshiyuki Maeda, Takahama (JP)

(73) Assignee: IBIDEN CO., LTD., Ogaki (JP)

( * ) Notice: Subject to any disclaimer, the term of this patent is extended or adjusted under 35 U.S.C. 154(b) by 260 days.

(21) Appl. No.: 18/730,319

(22) PCT Filed: Feb. 22, 2024

(86) PCT No.: PCT/JP2024/006546
§ 371 (c)(1),
(2) Date: Jul. 19, 2024

(87) PCT Pub. No.: WO2024/209826
PCT Pub. Date: Oct. 10, 2024

(65) Prior Publication Data

US 2026/0250908 A1 Aug. 27, 2026

(30) Foreign Application Priority Data

Apr. 3, 2023 (JP) ..... 2023-060456
Sep. 11, 2023 (JP) ..... 2023-147007

(51) Int. Cl.
*D21H 13/36* (2006.01)
*D21F 13/00* (2006.01)

(52) U.S. Cl.
CPC ..... *D21H 13/36* (2013.01); *D21F 13/00* (2013.01)

(58) Field of Classification Search
CPC ..... D21H 13/36; D21H 13/40; D21H 17/26; D21H 17/36; D21H 17/52; D21H 17/37;
(Continued)

(56) References Cited

U.S. PATENT DOCUMENTS 8,999,251 B2 4/2015 Sasaki et al.
2008/0078151 A1 4/2008 Kariya et al.
(Continued)

FOREIGN PATENT DOCUMENTS

CN 104968844 10/2015
CN 112601856 4/2021
(Continued)

*Primary Examiner* — Jose A Fortuna
(74) *Attorney, Agent, or Firm* — MORI & WARD, LLP

(57) ABSTRACT

A papermaking mat with a sufficiently high surface pressure is provided. The papermaking mat of the present invention includes: inorganic fibers including inorganic fibers forming fiber bundles each formed from 10 or more of the inorganic fibers entangled and twisted together, and inorganic fibers forming no fiber bundles, wherein the fiber bundles have an average length of 5 to 15 mm, the fiber bundles have an average width of 0.2 to 1.0 mm, the fiber bundles include a crimped fiber bundle, and a trace length of the crimped fiber bundle is greater than a length of the crimped fiber bundle by 0.1 mm or more as measured by a trace length measurement method in which a crimped fiber bundle is placed still on a flat surface, and the crimped fiber bundle placed still is traced therealong from one end to another end thereof as viewed from above to determine a traced distance as "trace length of the crimped fiber bundle".

13 Claims, 5 Drawing Sheets

(58) Field of Classification Search
CPC ..... D21H 17/67; D21H 27/00; D04H 1/4209; D21F 13/00
See application file for complete search history.

(56) References Cited

U.S. PATENT DOCUMENTS

| | | | | |
|---|---|---|---|---|
| 2011/0227251 | A1 | 9/2011 | Kariya et al. | |
| 2019/0145031 | A1 | 5/2019 | Kimura | |
| 2024/0018889 | A1 | 1/2024 | Maeda et al. | |
| 2025/0109536 | A1* | 4/2025 | Yamazaki | D04H 1/4209 |

FOREIGN PATENT DOCUMENTS

| | | | | | |
|---|---|---|---|---|---|
| CN | 118632957 | B * | 5/2025 | | F02F 11/00 |
| EP | 3805450 | | 4/2021 | | |
| EP | 4012085 | | 6/2022 | | |
| EP | 4467714 | A1 * | 11/2024 | | F01N 3/28 |
| EP | 4403756 | B1 * | 3/2026 | | D21B 1/12 |
| JP | 2007-224481 | | 9/2007 | | |
| JP | 2008-082310 | | 4/2008 | | |
| JP | 2008-280637 | | 11/2008 | | |
| JP | 2015-167628 | | 9/2015 | | |
| JP | 2016-089776 | | 5/2016 | | |
| JP | 2016-107548 | | 6/2016 | | |
| JP | 2016-108987 | W | 6/2016 | | |
| JP | 2022-156707 | | 10/2022 | | |
| JP | 7352759 | B1 | 9/2023 | | |
| JP | 7847280 | B1 * | 4/2026 | | |
| JP | 2026065996 | A * | 4/2026 | | F01N 13/16 |
| WO | WO 2018/012423 | | 1/2018 | | |

* cited by examiner

Magnification : X20.0

Magnification : X20.0

Magnification : X20.0

Magnification : X20.0

PAPERMAKING MAT AND METHOD FOR PRODUCING PAPER MAKING MAT

TECHNICAL FIELD

The present invention relates to a papermaking mat and a method for producing a papermaking mat.

BACKGROUND ART

Exhaust gas discharged from an internal combustion engine such as a diesel engine contains a particulate matter (hereinafter, also referred to as "PM"). Adverse effects of PM on the environment and human bodies have been problems. The exhaust gas also contains harmful gas components such as CO, HC, and NOx, causing concerns about effects of such harmful gas components on the environment and human bodies.

In view of the above, various exhaust gas conversion apparatuses that collect PM in exhaust gas and convert harmful gas components have been proposed. Such an exhaust gas conversion apparatus includes an exhaust gas treatment unit including porous ceramic such as silicon carbide or cordierite, a casing for housing the exhaust gas treatment unit, and a holding sealing material (mat material) between the exhaust gas treatment unit and the casing. The holding sealing material (mat material) is disposed mainly, for example, for preventing the exhaust gas treatment unit from being damaged by contact with the casing that covers the periphery of the exhaust gas treatment unit due to vibrations and impacts caused by operation of automobiles or the like, and for preventing exhaust gas leakage from a space between the exhaust gas treatment unit and the casing.

For increasing the force (surface pressure) of the mat material for holding the exhaust gas treatment unit, Patent Literature WO2018/012423 discloses a mat material in which the surface pressure is improved by producing an alumina fiber aggregate using a specific spinning aid.

According to the disclosure of Patent Literature JP 2008-82310 A, a needled sheet is first produced, the needled sheet is then subjected to dry-type fiber opening to obtain opened fibers including massive aggregated fibers, and the opened fibers including the massive aggregated fibers are used to produce a papermaking sheet material. Further, Patent Literature JP 2008-82310 A discloses an increase in the surface pressure of the papermaking sheet material owing to the presence of the massive aggregated fibers therein.

SUMMARY OF INVENTION

Technical Problem

The mat material disclosed in Patent Literature WO 2018/012423 is made of easily breakable alumina fibers and is prone to a decrease in the surface pressure.

In the papermaking sheet material disclosed in Patent Literature JP 2008-82310 A, the needled sheet is subjected to dry-type fiber opening. Thus, the opened fibers are short in length, and the fibers constituting the massive aggregated fibers are also short in length. Therefore, the fibers constituting the massive aggregated fibers are not sufficiently entangled with each other, so that the massive aggregated fibers cannot be formed into a twisted shape. Such massive aggregated fibers are also short. Therefore, the massive aggregated fibers fail to achieve a sufficiently high elasticity, resulting in a difficulty in sufficiently increasing the surface pressure of a papermaking sheet material to be produced.

The present invention is made in view of the above problems and aims to provide a papermaking mat with a sufficiently high surface pressure.

Solution to Problem

Specifically, the papermaking mat of the present invention is a papermaking mat including: inorganic fibers including inorganic fibers forming fiber bundles each formed from 10 or more of the inorganic fibers entangled and twisted together, and inorganic fibers including inorganic fibers forming no fiber bundles, wherein the fiber bundles have an average length of 5 to 15 mm, the fiber bundles have an average width of 0.2 to 1.0 mm, the fiber bundles include a crimped fiber bundle, and a trace length of the crimped fiber bundle as measured by a trace length measurement method described below is greater than a length of the crimped fiber bundle by 0.1 mm or more: trace length measurement method:

a crimped fiber bundle is placed still on a flat surface; and the crimped fiber bundle placed still is traced therealong from one end to another end thereof as viewed from above to determine a traced distance as "trace length of the crimped fiber bundle".

The papermaking mat of the present invention includes fiber bundles of a predetermined size.

Such fiber bundles are formed from 10 or more of the inorganic fibers entangled and twisted together and are formed to have a predetermined length and width. These fiber bundles support each other and are thus not easily deformed by pressure. Therefore, when a pressure is applied to the papermaking mat, the fiber bundles serve as cores and can reduce the pressure applied to the inorganic fibers forming no fiber bundles. This makes it possible to prevent the inorganic fibers forming no fiber bundles from being broken by pressure. As a result, the papermaking mat of the present invention has a high surface pressure.

In the papermaking mat of the present invention, the fiber bundles include a crimped fiber bundle, and the trace length of the crimped fiber bundle as measured by the trace length measurement method described above is greater than the length of the crimped fiber bundle by 0.1 mm or more.

The crimped fiber bundle has elasticity, and a papermaking mat including such a fiber bundle has a high surface pressure.

Preferably, the papermaking mat of the present invention contains an organic binder in an amount of 0.1 to 20 parts by weight and an inorganic binder in an amount of 0.1 to 10 parts by weight per 100 parts by weight of the inorganic fibers.

The organic binder and the inorganic binder bond the inorganic fibers to each other and maintain the shape of the papermaking mat.

When the amounts of the organic binder and the inorganic binder are in the above ranges, adhesion between the inorganic fibers is appropriate, and both flexibility and shape maintainability of the papermaking mat can be achieved.

In addition, falling off of the inorganic fibers from the papermaking mat and scattering of the inorganic fibers can be reduced or prevented.

In the papermaking mat of the present invention, preferably, the organic binder has a glass transition temperature Tg of 5 °C or lower.

When the organic binder has a glass transition temperature Tg of 5 °C or lower, an organic binder film formed of the organic binder has high strength, and a papermaking mat having high film elongation and excellent flexibility can be obtained.

In the papermaking mat of the present invention, preferably, the organic binder is at least one selected from the group consisting of: acrylic resins, acrylate latices, rubber latices, carboxymethyl cellulose and polyvinyl alcohol, all of which act as water-soluble organic polymers; styrene resins that act as a thermoplastic resin; and epoxy resins that act as a thermosetting resin.

In the papermaking mat of the present invention, preferably, the inorganic binder contains at least one selected from the group consisting of alumina, silica, silicon carbide, zirconia, boron nitride, diamond, and pumice.

These organic binders and inorganic binders are suitable for bonding the inorganic fibers to each other and maintaining the shape of the papermaking mat.

In the papermaking mat of the present invention, the fiber bundles may include a straight fiber bundle.

The straight fiber bundle can be obtained by fiber opening, in water, a first inorganic fiber molded body derived from a needle-punched mat and a second inorganic fiber molded body derived from a papermaking mat.

The method for producing a papermaking mat of the present invention is a method for producing a papermaking mat, the method including: a fiber opening step of subjecting an inorganic fiber molded body to fiber opening in water and producing a slurry containing inorganic fibers that are opened; and a papermaking step of papermaking from the slurry to obtain a papermaking mat, wherein in the fiber opening step, fiber opening is performed such that the slurry contains the inorganic fibers that include: inorganic fibers forming fiber bundles each formed from 10 or more of the inorganic fibers entangled and twisted together and having an average length of 5 to 15 mm and an average width of 0.2 to 1.0 mm; and inorganic fibers forming no fiber bundles.

The method for producing a papermaking mat of the present invention includes papermaking from inorganic fibers obtained by subjecting an inorganic fiber molded body to fiber opening in water.

In fiber opening of the inorganic fiber molded body, there are cases where the inorganic fibers are not completely opened, resulting in fiber bundles of multiple fibers entangled and twisted together.

In the method for producing a papermaking mat of the present invention, such fiber bundles are intentionally generated.

The number of the inorganic fibers entangled and twisted together in each fiber bundle as well as the average length and the average width of the fiber bundles can be adjusted by adjusting fiber opening conditions.

A papermaking mat produced by such a method has a high surface pressure.

In the method for producing a papermaking mat of the present invention, preferably, the inorganic fiber molded body includes at least one of a first inorganic fiber molded body derived from a needle-punched mat or a second inorganic fiber molded body derived from a papermaking mat.

The fiber bundles can be formed in the fiber opening step regardless of whether the inorganic fiber molded body is derived from a needle-punched mat or a papermaking mat.

Advantageous Effects of Invention

The present invention can provide a papermaking mat with a sufficiently high surface pressure.

DESCRIPTION OF EMBODIMENTS

Hereinafter, the papermaking mat of the present invention is specifically described. The present disclosure is not limited to the features described below, and suitable modifications may be made without departing from the scope of the present invention. The present invention also encompasses a combination of two or more preferred features of the present invention described below.

A papermaking mat according to the present invention is described with reference to the drawings.

Figure 1A:
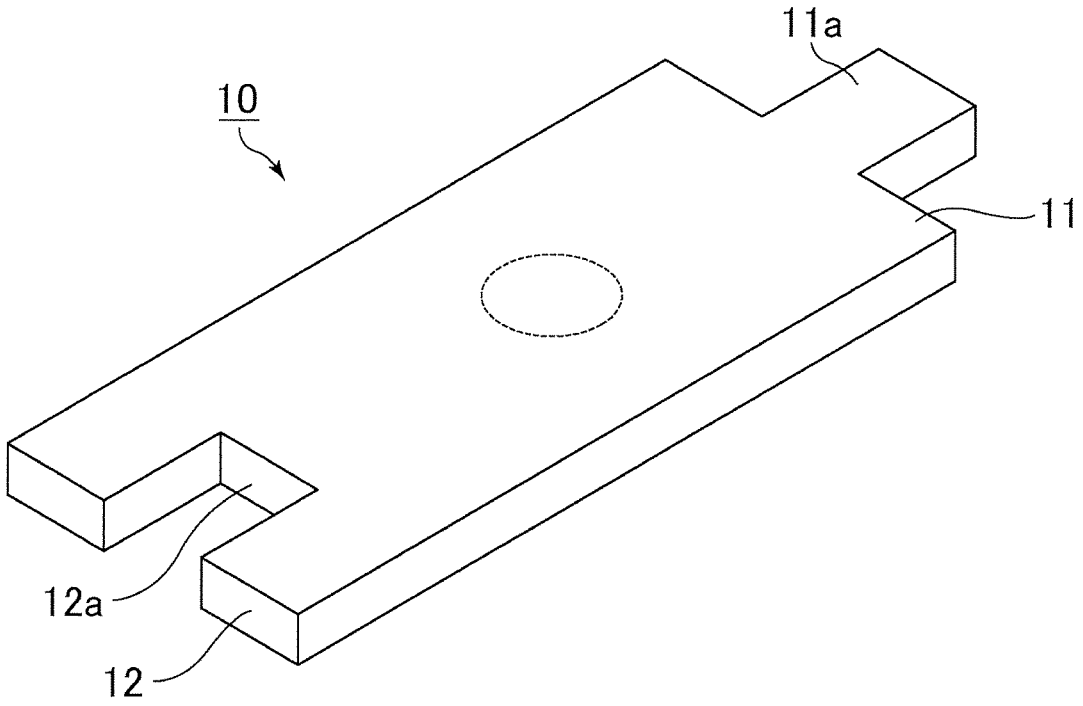
FIG. 1A is a schematic perspective view of an example of a papermaking mat of the present invention.

FIG. 1A is a schematic perspective view of an example of the papermaking mat of the present invention.

Figure 1B:
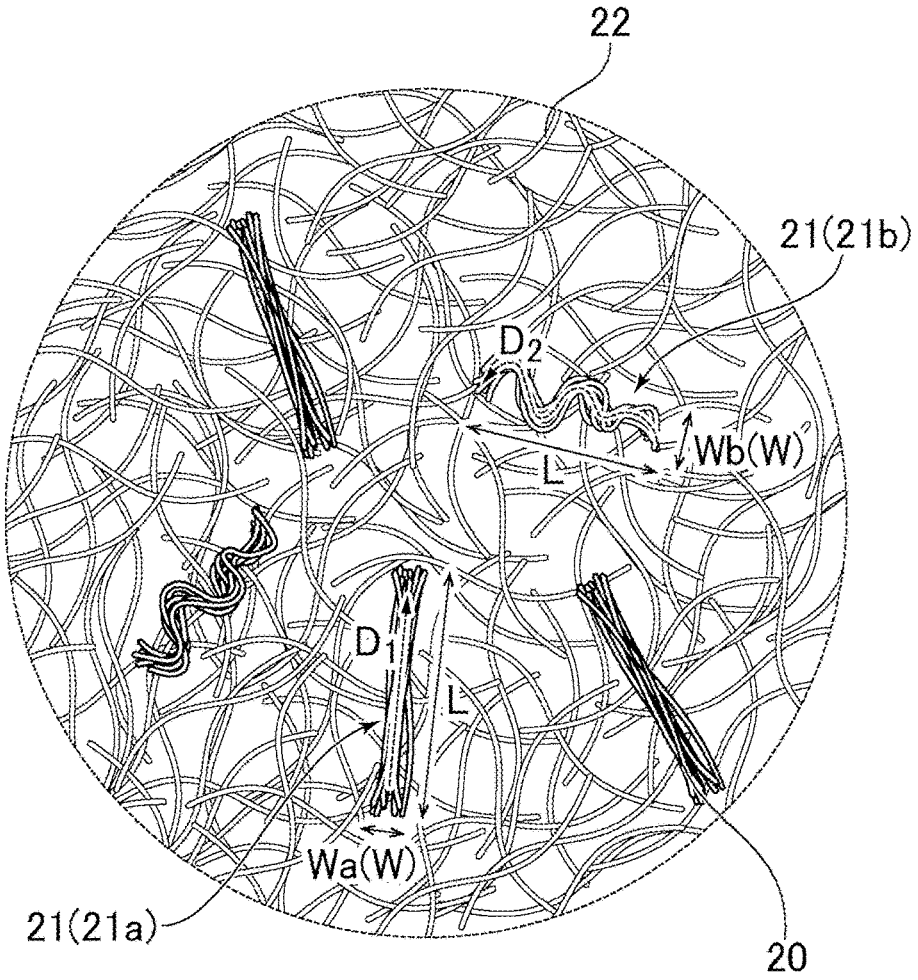
FIG. 1B is an enlarged view of a portion encircled by a broken line in FIG. 1A.

FIG. 1B is an enlarged view of a portion encircled by a broken line in FIG. 1A.

As shown in FIG. 1A, a papermaking mat 10 is a papermaking mat made of inorganic fibers.

The papermaking mat 10 has a rectangular shape in a plan view, with a protrusion 11*a* at one end 11 and a recess 12*a* at another end 12.

The papermaking mat 10 is wound around an exhaust gas treatment unit and disposed in an exhaust gas conversion apparatus, which is described in detail later.

The protrusion 11*a* and the recess 12*a* have shapes that are exactly fitted to each other when the papermaking mat 10 is wound around the exhaust gas treatment unit.

The protrusion 11*a* and the recess 12*a*, when provided, improve sealing properties when the papermaking mat 10 is disposed in the exhaust gas conversion apparatus described later.

The papermaking mat of the present invention may not include either a protrusion or a recess at the ends.

As shown in FIG. 1B, the papermaking mat 10 includes fiber bundles 21 each formed from 10 or more inorganic fibers 20 entangled in a twist manner, and inorganic fibers 22 forming no fiber bundles 21.

The fiber bundles 21 include a straight fiber bundle (a bundle in a state denoted by a reference sign "21*a*" in FIG. 1B) and a crimped fiber bundle (a bundle in a state denoted by a reference sign "21*b*" in FIG. 1B).

In the papermaking mat 10, the fiber bundles 21 include a crimped fiber bundle 21*b* as an essential element.

The expression "straight" as used herein refers to a state in which the fiber bundle extends linearly in the direction of the fiber bundle (the direction indicated by an arrow D1 in FIG. 1B).

The expression "crimped" as used herein refers to a state in which the fiber bundle is curved at least one in the direction of the fiber bundle (the direction indicated by an arrow D2 in FIG. 1B).

The average length (the average of lengths denoted by reference signs L in FIG. 1B) of the fiber bundles 21 is 5 to 15 mm. The average length of the fiber bundles 21 is preferably 7 to 13 mm, more preferably 8 to 10 mm.

The average width (the average of widths denoted by reference signs W in FIG. 1B) of the fiber bundles is 0.2 to 1.0 mm. The average width of the fiber bundles 21 is preferably 0.2 to 0.8 mm.

As shown in FIG. 1B, when the fiber bundle 21 is a straight fiber bundle 21*a*, its maximum width (the length denoted by a reference sign Wa FIG. 1B) is the width of the fiber bundle 21. Likewise, when the fiber bundle 21 is a crimped fiber bundle 21*b*, its maximum width (the length denoted by a reference sign Wb in FIG. 1B) is the width of the fiber bundle 21.

The fiber bundles 21 are each formed from 10 or more of the inorganic fibers 20 entangled and twisted together. Such fiber bundles support each other and are thus not easily deformed by pressure. Therefore, when a pressure is applied to the papermaking mat 10, the fiber bundles 21 serve as cores and can reduce the pressure applied to the inorganic fibers 22 forming no fiber bundles 21. This makes it possible to prevent the inorganic fibers 22 forming no fiber bundles 21 from being broken by pressure. As a result, the papermaking mat 10 has a high surface pressure.

In particular, when the fiber bundles 21 are the crimped fiber bundles 21*b*, the above effect is suitably exerted, further increasing the surface pressure of the papermaking mat 10.

When the fiber bundles have an average length of less than 5 mm, such fiber bundles are too short and are thus less likely to serve as cores to alleviate the pressure applied to the inorganic fibers forming no fiber bundles.

When the fiber bundles have an average length of more than 15 mm, such fiber bundles are too long and are thus easy to bend when a pressure is applied to their lateral sides. Thus, the fiber bundles are less likely to serve as cores.

When the fiber bundles have an average width of less than 0.2 mm, such fiber bundles are low in strength and easy to bend. Thus, the fiber bundles are less likely to serve as cores.

When the fiber bundles have an average width of more than 1.0 mm, such fiber bundles are too high in strength, resulting in a low flexibility of the entire papermaking mat.

The term "fiber bundle" as used herein refers to a portion where the inorganic fibers are concentrated at a higher density than they are in other portions of the papermaking mat.

The expression "fiber bundles formed from the inorganic fibers entangled and twisted together" as used herein refers to the following fiber bundles.

The papermaking mat of the present invention is produced from inorganic fibers obtained by subjecting a needle-punched mat and a papermaking mat to fiber opening, as described in detail later.

In fiber opening of a needle-punched mat and a papermaking mat, there are cases where the inorganic fibers are not completely opened, resulting in fiber bundles of multiple fibers entangled and twisted together.

When producing a needle-punched mat, the inorganic fibers are entangled with each other with a needle, so that the inorganic fibers are highly entangled with each other at the needle-punched portion.

When producing a papermaking mat, the inorganic fibers are bonded to each other with an organic binder, so that the inorganic fibers are less likely to be separated from each other. When producing a papermaking mat by a papermaking method, unevenness occurs in aggregates of the inorganic fibers, forming a dense inorganic fiber aggregate.

The portion in which the inorganic fibers are entangled with each other with a needle in a needle-punched mat and the portion in which the inorganic fibers are aggregated at a high density in a papermaking mat are not easily opened and remain as fiber bundles formed from the inorganic fibers entangled and twisted together.

The fiber bundles that remain in fiber opening of a needle-punched mat and a papermaking mat are "the fiber bundles formed from the inorganic fibers entangled and twisted together" described herein.

The papermaking mat of the present invention includes fiber bundles in which the inorganic fibers are entangled and twisted together.

The terms "average length" and "average width" of the fiber bundles refer to values measured as described below.

The papermaking mat is cut into a 150 $cm^3$ test piece.

Subsequently, the test piece is fired at 600 °C for one hour to thermally decompose binder components.

Next, the test piece is placed in a container, and the container is shaken vertically and horizontally to loosen the inorganic fibers constituting the test piece.

A fiber bundle is taken out from the loosened test piece, and the length and width of the fiber bundle are measured.

The same procedure is repeated three times, and the average length and the average width of the obtained fiber bundles are calculated.

In calculating the average length and the average width of the fiber bundles, the fiber bundles each formed from less than 10 inorganic fibers are excluded from the calculation.

As long as the mat material of the present invention includes fiber bundles having an average length of 5 to 15 mm and an average width of 0.2 to 1.0 mm, the mat material may include a fiber bundle having a length of less than 5 mm, a fiber bundle having a length of more than 15 mm, a fiber bundle having a width of less than 0.2 mmm, and a fiber bundle having a width of more than 1.0 mm.

As described above, the papermaking mat 10 includes the crimped fiber bundle 21*b* as an essential element.

The crimped fiber bundle 21*b* is described in detail below with reference to the drawing.

Figure 2:
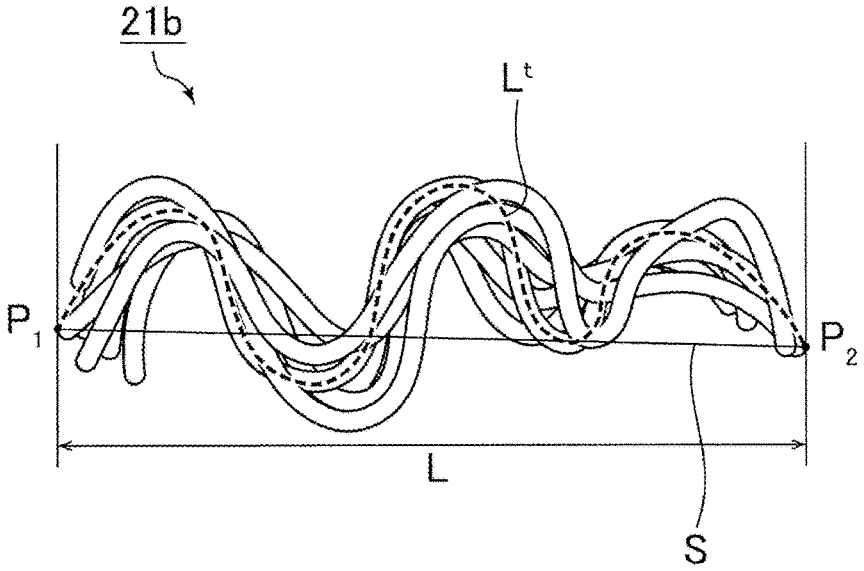
FIG. 2 is a schematic view of an example of a crimped fiber bundle included in the papermaking mat of the present invention.

FIG. 2 is a schematic view of an example of the crimped fiber bundle included in the papermaking mat of the present invention.

In the crimped fiber bundle 21*b* shown in FIG. 2, preferably, a trace length $L^t$ of the crimped fiber bundle 21*b* measured by a trace length measurement method described below is greater than a length L of the crimped fiber bundle 21*b* by preferably 0.1 mm or more, more preferably 0.2 to 0.6 mm.

(Trace Length Measurement Method)

The crimped fiber bundle 21*b* is placed still on a flat surface.

Next, the crimped fiber bundle 21*b* placed still is traced therealong from one end $P_1$ to another end $P_2$ of the crimped fiber bundle 21*b* viewed from above, and the traced distance $L^t$ is defined as "the trace length of the crimped fiber bundle".

When the trace length $L^t$ of the crimped fiber bundle 21*b* is greater than the length L of the crimped fiber bundle 21*b*, the crimped fiber bundle 21*b* has a high elasticity, increasing the surface pressure of the papermaking mat 10.

Preferably, in the papermaking mat 10, the crimped fiber bundle 21*b* shown in FIG. 2 includes a crimped fiber bundle 21*b* in which a line segment S interconnecting the end $P_1$ and the end $P_2$ is crossed two or more times during tracing of the crimped fiber bundle 21*b* in measuring the "trace length of the crimped fiber bundle".

The degree of crimp of such a crimped fiber bundle 21*b* is suitable, increasing the elasticity of the crimped fiber bundle 21*b* and improving the surface pressure of the papermaking mat 10.

In the papermaking mat 10, the ratio of the trace length $L^t$ of the crimped fiber bundle 21*b* to the length L of the crimped fiber bundle 21*b* is preferably as follows: $L^t/L=1.1$ to 1.6.

In the papermaking mat 10, the value of the following formula (1) is preferably 0.1 or more, more preferably 0.2 to 0.6.

$$(L^t-L)/Wb \quad (1)$$

In the papermaking mat 10, preferably, the area of the crimped fiber bundle 21*b* placed still and viewed from the above is 2.6 to 8.3 $mm^2$.

In the papermaking mat 10, the percentage of the number of the crimped fiber bundles 21*b* within the fiber bundles 21 is preferably 85% or less, more preferably 60% or less, still more preferably 30% or less, yet still more preferably 10 to 30%.

Preferably, the inorganic fibers 20 constituting the papermaking mat 10 include at least one selected from alumina fibers, silica fibers, alumina-silica fibers, mullite fibers, glass fibers, and bio-soluble fibers.

The papermaking mat 10 including these inorganic fibers has a sufficient heat resistance.

Preferably, the inorganic fibers 20 constituting the papermaking mat 10 have an average fiber diameter of 2 to 10 μm and an average fiber length of 0.01 to 5.0 mm.

Preferably, the bulk density of the papermaking mat 10 is 0.05 to 0.30 $g/cm^3$.

When the bulk density of the papermaking mat 10 is less than 0.05 $g/cm^3$, the entanglement of the inorganic fibers is weak, and the inorganic fibers are easily separated from each other, making it difficult to maintain the shape of the papermaking mat in a predetermined shape.

When the bulk density of the papermaking mat 10 is more than 0.30 $g/cm^3$, the papermaking mat is hard with poor winding properties and is prone to tearing.

The papermaking mat 10 contains an organic binder in an amount of preferably 0.1 to 20 parts by weight, more preferably 0.5 to 10 parts by weight, per 100 parts by weight of the inorganic fibers 20.

The papermaking mat 10 contains an inorganic binder in an amount of preferably 0.1 to 10 parts by weight, more preferably 0.5 to 3.0 parts by weight, per 100 parts by weight of the inorganic fibers 20.

The organic binder and the inorganic binder bond the inorganic fibers to each other and maintain the shape of the papermaking mat.

When the amounts of the organic binder and the inorganic binder are in the above ranges, adhesion between the inorganic fibers is appropriate, and both flexibility and shape maintainability of the papermaking mat can be achieved.

In addition, falling off of the inorganic fibers from the papermaking mat and scattering of the inorganic fibers can be reduced or prevented.

In the papermaking mat 10, the glass transition temperature Tg of the organic binder is preferably 5 °C or lower, more preferably −35 to 5 °C.

When the organic binder has a glass transition temperature Tg of 5 °C or lower, an organic binder film formed of the organic binder has high strength, and a papermaking mat having high film elongation and excellent flexibility can be obtained.

The papermaking mat 10 also becomes less prone to tearing when being wound around an exhaust gas treatment unit, for example. Further, the resulting organic binder film is not too hard, so that it exhibits an effect of keeping the inorganic fibers connected to each other at breakage of the inorganic fibers and can reduce or prevent the inorganic fibers from scattering.

When the glass transition temperature Tg of the organic binder is higher than 5 °C, the resulting papermaking mat may have a low flexibility and a low degree of breaking elongation.

In the papermaking mat of the present invention, the organic binder may be a water-soluble organic polymer, a thermoplastic resin, or a thermosetting resin.

Examples of the water-soluble organic polymer include acrylic resins, acrylate latexes, rubber latexes, carboxymethyl cellulose, and polyvinyl alcohol. Examples of the thermoplastic resin include styrene resins. Examples of the thermosetting resin include epoxy resins.

In the papermaking mat 10, preferably, the inorganic binder contains at least one selected from alumina, silica, silicon carbide, zirconia, boron nitride, diamond, and pumice.

These organic binders and inorganic binders are suitable for bonding the inorganic fibers to each other and maintaining the shape of the papermaking mat.

Next, a method for producing a papermaking mat of the present invention is described.

The method for producing a papermaking mat of the present invention includes (1) fiber opening step and (2) papermaking step.

In the following, a description is given on a case where both a first inorganic fiber molded body derived from a needle-punched mat and a second inorganic fiber molded body derived from a papermaking mat are used as inorganic fiber molded bodies. Yet, the method for producing a papermaking mat of the present invention may use either one of the inorganic fiber molded bodies.

Each step is described in detail below.

(1) Fiber Opening Step

In this step, a first inorganic fiber molded body derived from a needle-punched mat and a second inorganic fiber molded body derived from a papermaking mat are subjected to fiber opening in water to produce a slurry containing inorganic fibers that are opened.

In this step, fiber opening is performed such that the slurry contains fiber bundles each formed from 10 or more of the inorganic fibers entangled and twisted together and having an average length of 5 to 15 mm and an average width of 0.2 to 1.0 mm, and the inorganic fibers forming no fiber bundles.

Preferably, dry-type fiber opening is not performed in this step.

In fiber opening of a needle-punched mat and a papermaking mat, there are cases where the inorganic fibers are not completely opened, resulting in fiber bundles of multiple fibers entangled and twisted together.

A more specific description is as follows.

When producing a needle-punched mat, the inorganic fibers are entangled with each other with a needle, so that the inorganic fibers are highly entangled with each other at the needle-punched portion.

When producing a papermaking mat, the inorganic fibers are bonded to each other with an organic binder, so that the inorganic fibers are less likely to be separated from each other. When producing a papermaking mat by a papermaking method, unevenness occurs in aggregates of the inorganic fibers, forming a dense inorganic fiber aggregate.

The portion in which the inorganic fibers are entangled with each other with a needle in a needle-punched mat and the portion in which the inorganic fibers are aggregated at a high density in a papermaking mat are not easily opened and remain as fiber bundles formed from the inorganic fibers entangled and twisted together.

In the method for producing a papermaking mat of the present invention, such fiber bundles are intentionally generated.

The number of the inorganic fibers entangled and twisted together in each fiber bundle as well as the average length and the average width of the fiber bundles can be adjusted by adjusting fiber opening conditions.

The fiber opening conditions are not limited. For example, in the case of fiber opening in water using a stirrer, the number of the inorganic fibers entangled and twisted together in each fiber bundle as well as the average length and the average width of the fiber bundles can be adjusted by adjusting the rotation speed of the stirrer and the stirring time.

If dry-type fiber opening is performed in this step, the inorganic fibers become easily breakable, reducing the length of the fiber bundles. This results in short fiber bundles, making it impossible to obtain fiber bundles having a desired shape.

Thus, preferably, dry-type fiber opening is not performed in this step.

The fiber bundles to be formed in this step may be derived from the first inorganic fiber molded body or the second inorganic fiber molded body.

The fiber bundles can be formed in the fiber opening step regardless of whether the inorganic fiber molded body is derived from the first inorganic fiber molded body (needle-punched mat) or the second inorganic fiber molded body (papermaking mat).

Examples of the fiber opening include the following methods.

First, the first inorganic fiber molded body and the second inorganic fiber molded body are fired at 700 °C to 1000 °C for 1.0 to 8.0 hours. A preferred firing temperature is 800 °C to 950 °C.

Thus, the organic binders in the first inorganic fiber molded body and the second inorganic fiber molded body can be thermally decomposed, facilitating fiber opening of the first inorganic fiber molded body and the second inorganic fiber molded body.

Next, the fired first inorganic fiber molded body and the fired second inorganic fiber molded body are left standing stand until cooled to room temperature. Then, the first inorganic fiber molded body and the second inorganic fiber molded body are loosened by hand.

Next, the first inorganic fiber molded body and the second inorganic fiber molded body are put in water and stirred for fiber opening, with the amount of water being 50 to 400 times (in weight ratio) the amount of the first inorganic fiber molded body and the second inorganic fiber molded body. Thus, a slurry containing inorganic fibers is produced. Preferably, the amount of water is 100 to 200 times in weight ratio the amount of the first inorganic fiber molded body and the second inorganic fiber molded body.

Preferably, stirring conditions are suitably set. For example, in the case of producing 10 L of a slurry, stirring is preferably performed using a stirrer (product name: SMT-101, manufacturer: AS ONE Corporation) at a rotation speed of 500 to 1000 rpm for a stirring time of 200 to 900 seconds. Preferably, the rotation speed is 650 to 850 rpm and the stirring time is 500 to 700 seconds. More preferably, the rotation speed is 700 to 800 rpm and the stirring time is 500 to 650 seconds.

When the slurry is dried, fiber opening is performed to form fiber bundles each formed from 10 or more of the inorganic fibers entangled and twisted together and having an average length of 5 to 15 mm and an average width of 0.2 to 1.0 mm.

Next, an organic binder and an inorganic binder are added to the slurry.

The organic binder is added such that its amount in a papermaking mat to be produced is preferably 0.1 to 20 parts by weight, more preferably 0.5 to 15.0 parts by weight, per 100 parts by weight of the inorganic fibers.

The inorganic binder is added such that its amount in a papermaking mat to be produced is preferably 0.1 to 15.0 parts by weight, more preferably 0.5 to 10 parts by weight, per 100 parts by weight of the inorganic fibers.

Since the types of preferred organic binders and inorganic binders have already been described, a description thereof is omitted here.

(2) Papermaking Step

Next, the slurry is poured into a molding machine having a mesh for filtering on its bottom to remove a solvent in the slurry, whereby an inorganic fiber aggregate is obtained. Then, the inorganic fiber aggregate is dehydrated and dried, whereby the papermaking mat of the present invention can be obtained.

In the papermaking step, the inorganic fiber aggregate may be dried by thermal compression. During thermal compression, the inorganic fiber aggregate may be heat-treated for drying by passing hot air therethrough or may be in a wet state without being heat-treated.

In the heat treatment, if performed, the heating temperature and the hot air temperature are preferably 150 °C to 210 °C in order to prevent thermal deterioration of the organic binder.

In the range of 150 °C to 210 °C, it is possible to remove the water content from the inorganic fiber aggregate while preventing deterioration of the organic binder. When the heating temperature and the hot air temperature are lower than 150 °C, the temperature does not transfer to a central portion of the inorganic fiber aggregate, resulting in a longer drying time. When the heating temperature and the hot air temperature are higher than 210 °C, the organic binder is deteriorated, and the binding force between fibers is reduced, making it difficult to control the thickness of the inorganic fiber aggregate.

In the method for producing a papermaking mat of the present invention, preferably, batchwise papermaking or continuous papermaking is performed in the papermaking step.

Batchwise papermaking or continuous papermaking facilitates production of the papermaking mat of the present invention.

The papermaking mat of the present invention includes, as one embodiment, a papermaking mat produced by a fiber opening step of subjecting an inorganic fiber molded body to fiber opening in water and producing a slurry containing inorganic fibers that are opened and a papermaking step of papermaking from the slurry to obtain a papermaking mat, wherein in the fiber opening step, fiber opening is performed such that the slurry contains fiber bundles each formed from 10 or more of the inorganic fibers entangled and twisted together and having an average length of 5 to 15 mm and an average width of 0.2 to 1.0 mm, and the inorganic fibers forming no fiber bundles.

In the fiber opening step, preferably, the slurry includes a crimped fiber bundle, and the trace length of the crimped fiber bundle as measured by the trace length measurement method described above is greater than the length of the crimped fiber bundle by 0.1 mm or more.

Next, a method for using the papermaking mat of the present invention is described.

Figure 3:
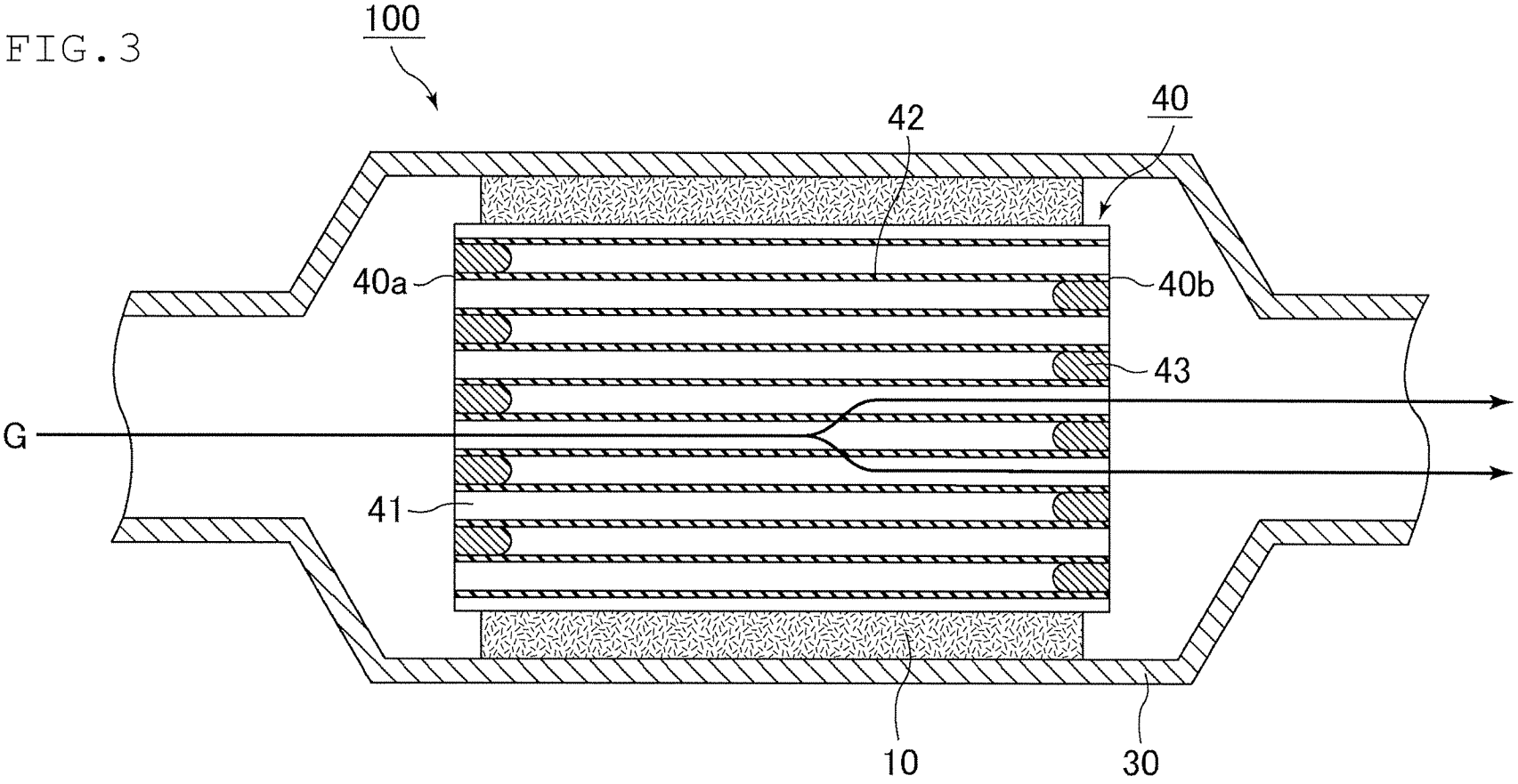
FIG. 3 is a schematic cross-sectional view of an example of an exhaust gas conversion apparatus in the present invention.

FIG. 3 is a schematic cross-sectional view of an example of the exhaust gas conversion apparatus in the present invention.

As shown in FIG. 3, an exhaust gas conversion apparatus 100 includes a metal casing 30, an exhaust gas treatment unit 40 housed in the metal casing 30, and the papermaking mat 10 between the exhaust gas treatment unit 40 and the metal casing 30. The papermaking mat 10 is the papermaking mat of the present invention.

The exhaust gas treatment unit 40 has a pillar shape in which many cells 41 are arranged in parallel in a longitudinal direction with a cell wall 42 between the cells. If necessary, an inlet tube for introducing exhaust gas discharged from an internal combustion engine and an outlet tube for discharging the exhaust gas that has passed through the exhaust gas conversion apparatus are connected to ends of the casing 30.

In the exhaust gas conversion apparatus 100 shown in FIG. 3, although the exhaust gas treatment unit 40 is an exhaust gas filter (honeycomb filter) in which one of the ends of each cell is plugged with a plug 43, the exhaust gas treatment unit 40 may be a catalyst carrier not plugged with plugs at either end surface.

As shown in FIG. 3, the exhaust gas that was discharged from the internal combustion engine and that flowed into the exhaust gas conversion apparatus 100 (in FIG. 3, the exhaust gas is denoted by G, and the exhaust gas flow is indicated by arrows) flows into one of the cells 41 open at an exhaust gas inlet-side end 40*a* of the exhaust gas treatment unit (honeycomb filter) 40, and then passes through the cell wall 42 between the cells 41. At this point, PM in the exhaust gas is collected by the cell wall 42, and the exhaust gas is converted. The converted exhaust gas flows out from another cell 41 open at an exhaust gas discharge-side end 40*b* and is discharged to the outside.

As described above, the papermaking mat 10 has a high surface pressure. Therefore, in the exhaust gas conversion apparatus 100, even when the exhaust gas treatment unit 40 is exposed to high pressure from the exhaust gas, falling off of the exhaust gas treatment unit 40 from the metal casing 30 can be prevented.

The exhaust gas treatment unit 40 may include a porous non-oxide ceramic such as silicon carbide or silicon nitride or may include a porous oxide ceramic such as SiAlON, alumina, cordierite, or mullite. Silicon carbide is preferred among these.

When the exhaust gas treatment unit 40 is a silicon carbide porous ceramic, the porosity of the porous ceramic is not limited but is preferably 35 to 60%.

When the porosity is less than 35%, the exhaust gas treatment unit may be quickly clogged. In contrast, when the porosity is more than 60%, the exhaust gas treatment unit may have low strength and easily break.

Preferably, the porous ceramic has an average pore size of 5 to 30 μm.

When the average pore size is less than 5 μm, clogging with PM may easily occur.

When the average pore size is more than 30 μm, the exhaust gas treatment unit may not function as a filter because PM passes through the pores and cannot be collected.

The porosity and the pore size can be measured by a conventionally known method for measurement using a scanning electron microscope (SEM).

The cell density on a cross section of the exhaust gas treatment unit 40 is not limited, but a preferred lower limit is 31.0 pcs/cm$^2$ (200 pcs/inch$^2$) and a preferred upper limit is 93.0 pcs/cm$^2$ (600 pcs/inch$^2$). A more preferred lower limit is 38.8 pcs/cm$^2$ (250 pcs/inch$^2$) and a more preferred upper limit is 77.5 pcs/cm$^2$ (500 pcs/inch$^2$).

The exhaust gas treatment unit 40 may support a catalyst for converting the exhaust gas. Preferred examples of the catalyst to be supported include noble metals such as platinum, palladium, and rhodium, with platinum being more preferred. As another catalyst, for example, an alkali metal such as potassium or sodium, or an alkaline earth metal such as barium can also be used. These catalysts may be used alone or in combination of two or more thereof.

These catalysts, when supported, facilitate removal of PM by combustion and enable conversion of toxic exhaust gas.

(Metal Casing)

The metal casing 30 has a substantially cylindrical shape.

Preferably, the inner diameter of the metal casing 30 (inner diameter of a portion for housing the exhaust gas treatment unit) is slightly smaller than the diameter of the exhaust gas treatment unit 40 around which the papermaking mat 10 is wound.

The metal casing 30 is preferably made of stainless steel, although not limited thereto.

EXAMPLES

The following describes Examples that more specifically disclose the present invention. The present invention is not limited to these Examples.

Example 1

A first inorganic fiber molded body derived from a needle-punched mat was prepared. The first inorganic fiber molded body was made of alumina-silica fibers having a $Al_2O_3$:$SiO_2$ ratio of 72:28 (weight ratio) and had a bulk density of 0.17 g/cm$^3$ and a needle hole density of 21 pcs/cm$^2$.

Also, a second inorganic fiber molded body derived from a papermaking mat was prepared. The second inorganic fiber molded body was made of alumina-silica fibers having a $Al_2O_3$:$SiO_2$ ratio of 72:28 (weight ratio) and had a bulk density of 0.12 g/cm$^3$.

Next, the first inorganic fiber molded body and the second inorganic fiber molded body were fired at 800 °C for one hour to thermally decompose organic binders in the first inorganic fiber molded body and the second inorganic fiber molded body.

Next, the fired first inorganic fiber molded body and the fired second inorganic fiber molded body were left standing until cooled to room temperature. Then, the first inorganic fiber molded body and the second inorganic fiber molded body were loosened by hand.

Next, 5.0 g of the first inorganic fiber molded body and 5.0 g of the second inorganic fiber molded body were taken out and put in 0.4 L water. Subsequently, fiber opening was performed by stirring using a stirrer (product name: SMT-101, manufacturer: AS ONE Corporation) at a rotation speed of 1000 rpm for a stirring time of 10 minutes, whereby a slurry of inorganic fibers was produced.

A part of the slurry was taken out and dried in order to check for formation of fiber bundles in the slurry. The slurry was found to have formed a fiber bundles of 10 or more of the inorganic fibers entangled and twisted together.

Next, an organic binder was added to the slurry such that the amount of the organic binder was 0.5 to 10 parts by weight per 100 parts by weight of the inorganic fibers.

In addition, an organic binder was added to the slurry such that the amount of the organic binder was 0.5 to 3.0 parts by weight per 100 parts by weight of the inorganic fibers.

Next, the slurry was poured into a molding machine having a mesh for filtering on its bottom to remove a solvent in the slurry, whereby an inorganic fiber aggregate was obtained. Subsequently, the inorganic fiber aggregate was dehydrated and dried at 150 °C to 210 °C for five minutes to one hour, whereby a papermaking mat according to Example 1 was produced.

(Fiber Bundle Observation 1)

The papermaking mat according to Example 1 was cut into a 150 $cm^3$ test piece.

Subsequently, the test piece was fired at 600 °C for one hour to thermally decompose binder components.

Next, the test piece was placed in a container, and the container was shaken vertically and horizontally to loosen the inorganic fibers constituting the test piece.

Fiber bundles were randomly taken out from the loosened test piece, and the length and width of each fiber bundle were measured.

The same procedure was repeated three times, and the average length and the average width of the fiber bundles were calculated.

As a result, the average length of the fiber bundles was 8 mm, and the average width of the fiber bundles was 0.393 mm.

Figure 4A:
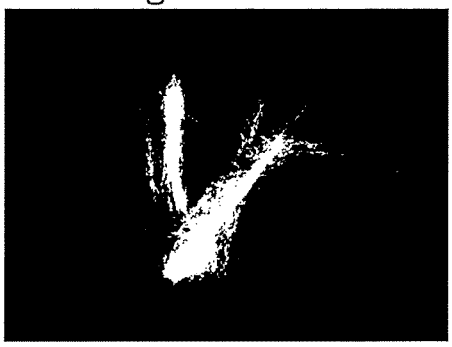
FIG. 4A is a photo of a straight fiber bundle included in a papermaking mat according to Example 1.
Figure 4B:
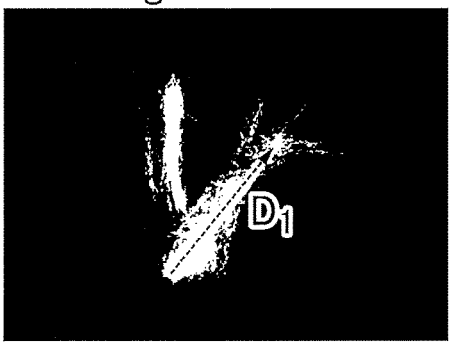
FIG. 4B is a photo showing the direction of the fiber bundle shown in FIG. 4A.
Figure 5A:
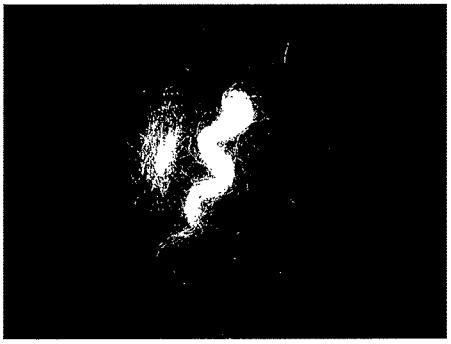
FIG. 5A is photo of a crimped fiber bundle included in the papermaking mat according to Example 1.
Figure 5B:
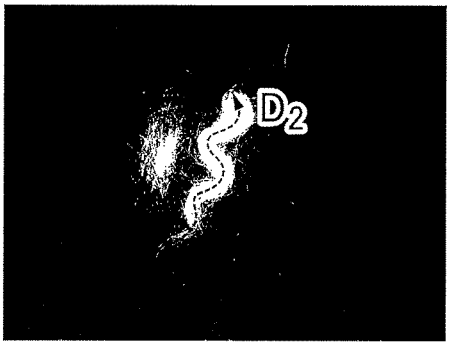
FIG. 5B a photo showing the direction of the fiber bundle shown in FIG. 5A.

FIG. 4A and FIG. 5A show photos of fiber bundles included in the papermaking mat according to Example 1. FIG. 4B and FIG. 5B show the directions of the respective fiber bundles.

FIG. 4A is a photo of a straight fiber bundle included in the papermaking mat according to Example 1.

FIG. 4B is a photo showing the direction of the fiber bundle shown in FIG. 4A.

FIG. 5A is photo of a crimped fiber bundle included in the papermaking mat according to Example 1.

FIG. 5B a photo showing the direction of the fiber bundle shown in FIG. 5A.

The fiber bundle shown in FIG. 4B is a straight fiber bundle, with its direction along the arrow D1.

The fiber bundle shown in FIG. 5B is a crimped fiber bundle, with its direction along the arrow D2.

(Example 2), (Comparative Example 1), and (Comparative Example 2)

Papermaking mats according to Example 2, Comparative Example 1, and Comparative Example 2 were produced as in Example 1, except that the stirring time was changed when producing a slurry of inorganic fibers by subjecting each inorganic fiber molded body to fiber opening with a stirrer and that the average length of the fiber bundles included in a papermaking mat to be produced was adjusted as shown in Table 1.

TABLE 1

| | Average length of fiber bundles (mm) | Surface pressure (kPa) |
|---|---|---|
| Comparative Example 1 | 4 | 88.6 |
| Example 1 | 8 | 97.0 |
| Example 2 | 10 | 104.8 |
| Comparative Example 2 | 18 | 92.2 |
| Comparative Example 3 | 20 | 87.4 |

Comparative Example 3

Silica sol was added to an aqueous basic aluminum chloride solution to obtain inorganic fibers having a compositional ratio of $Al_2O_3$:$SiO_2$=72:28 (weight ratio) after firing. Further, an appropriate amount of an organic polymer (polyvinyl alcohol) was added thereto. Thus, a liquid mixture was prepared.

The resulting liquid mixture was concentrated into a spinning mixture, and the spinning mixture was spun by blowing (spinning atmosphere temperature: 120 °C), whereby an alumina fiber precursor was produced.

Next, the resulting inorganic fiber precursor was compressed into a continuous sheet. Subsequently, the sheet was placed in a heating furnace and fired, whereby an inorganic fiber aggregate was produced.

Next, the inorganic fiber aggregate was subjected to fiber opening by stirring using a stirrer (product name: SMT-101, manufacturer: AS ONE CORPORATION) at a rotation speed of 1000 rpm for a stirring time of 10 minutes.

A part of the slurry was taken out and dried in order to check for formation of fiber bundles in the slurry. The slurry was found to have formed a fiber bundles, but the inorganic fibers were not twisted in the fiber bundles.

Next, the slurry was poured into a molding machine having a mesh for filtering on its bottom to remove a solvent in the slurry, whereby an inorganic fiber aggregate was obtained. Subsequently, the inorganic fiber aggregate was dehydrated and dried at 150 °C to 210 °C for five minutes to one hour, whereby a papermaking mat according to Comparative Example 3 was produced.

The papermaking mat according to Comparative Example 3 was observed by the same method as described in "(Fiber bundle observation 1)" described above. As a result, the papermaking mat included fiber bundles formed from untwisted inorganic fibers. The average length of the fiber bundles was 20 mm. The average width of the fiber bundles was 0.37 mm.

(Surface Pressure Measurement)

The papermaking mats according to Examples 1 and 2 and Comparative Examples 1 to 3 were set in a tester (product name: SMT-101, manufacturer: AS ONE Corporation) and compressed at a speed of 25.4 mm/min to a gap bulk density (GBD) of 0.40 $mm^3$/g. These papermaking mats were maintained with a gap bulk density (GBD) of 0.40 $mm^3$/g for 10 minutes.

Subsequently, the surface pressure of each papermaking mat was measured. Table 1 shows the results.

As shown in Table 1, the papermaking mat according to each Example was found to have a high surface pressure.

Comparative Example 4

Silica sol was added to an aqueous basic aluminum chloride solution having an aluminum content of 70 g/l and a Al/Cl ratio of 1.8 (atomic ratio) to obtain an alumina fiber having a composition of $Al_2O_3$:$SiO_2$=72:28, whereby an alumina fiber precursor was formed. Next, an organic polymer such as polyvinyl alcohol was added to the alumina fiber precursor. Further, the resulting mixture was concentrated into a spinning solution, and the spinning solution was spun by blowing. Subsequently, the alumina fiber precursor was folded and stacked, whereby a multilayer sheet of alumina fibers was produced. Next, the multilayer sheet was subjected to needling. A needle board having needles at a density of 50 pcs/100 $cm^2$ was placed on each of the front and back sides of the multilayer sheet to perform needling on both sides of the multilayer sheet. Thus, a multilayer sheet having an entanglement point density of about 1 pc/$cm^2$ or so was obtained.

Subsequently, the resulting multilayer sheet was continuously fired from room temperature to a maximum temperature of 1250 °C. Thus, a needled sheet material having a thickness of about 7 mm was obtained.

Next, the needled sheet material was roughly cut into dimensions of 200 mm×200 mm or smaller. Then, the resulting pieces were fed into a feather mill device (FM-1 available from Hosokawa Micron) for dry-type fiber opening, whereby opened fibers in the form of cotton having a diameter of about 150 mm were obtained.

Next, in order to prepare a raw material slurry, the resulting opened fibers (1200 g) and water (120000 g) were put into a stirrer for stirring for one minute. Next, an organic binder (latex) (60 g) was added to the solution, followed by stirring for another one minute. Next, an inorganic binder (alumina sol) (12 g) was added to the solution, followed by stirring for another one minute. Finally, a flocculant (Percol 292) (6 g) was added, followed by stirring for one minute. Thus, a raw material slurry was obtained.

Next, in order to form a molded body, the raw material slurry prepared as described above was transferred to a molding machine (vertical size 930 mm×horizontal size 515 mm×depth 400 mm) having a wire mesh for filtering (30 mesh) on its bottom for dehydration. The dehydration was performed using a suction pump such that the water content of the raw material slurry was forcibly sucked from the bottom side of the molding machine through the wire mesh for filtering.

Next, this molded body was taken out from the molding machine and compressed and dried at 120 °C and 70 kPa for 30 minutes. Through such a process, a papermaking mat having a thickness of 13 mm and a density of 0.19 g/$cm^3$ according to Comparative Example 4 was produced.

The papermaking mat according to Comparative Example 4 was observed by the same method as described in "(Fiber bundle observation 1)" described above. As a result, the papermaking mat included fiber bundles formed from untwisted inorganic fibers. The average length of the fiber bundles was 3 mm. The average width of the fiber bundles was 1.43 mm.

(Fiber Bundle Observation 2)

The papermaking mat according to Example 1 and the papermaking mat according to Comparative Example 4 were cut into 150 $cm^3$ test pieces.

Subsequently, the test pieces were fired at 600 °C for one hour to thermally decompose binder components.

Next, each test piece was placed in a container, and the container was shaken vertically and horizontally to loosen the inorganic fibers constituting the test piece.

Thirteen fiber bundles were randomly taken out from the test piece derived from the papermaking mat according to Example 1, and four fiber bundles were randomly taken out from the test piece derived from the papermaking mat according to Comparative Example 4.

The fiber bundles taken out from the test piece derived from the papermaking mat according to Example 1 included nine crimped fiber bundles and four straight fiber bundles.

The average length L of these crimped fiber bundles was 6.78 mm. The average area was 4.95 $mm^2$.

The average length L of these straight fiber bundles was 7.97 mm. The average area was 2.83 $mm^2$.

The fiber bundles taken out from the test piece derived from the papermaking mat according to Comparative Example 4 were all straight fiber bundles.

The average length L of these straight fiber bundles was 3.23 mm. The average area was 3.41 $mm^2$.

Each crimped fiber bundle in Example 1 was placed still on a flat surface. The trace length $L^t$ of the fiber bundle as viewed from above was measured and its average was calculated.

Then, the difference ($L^t$–L) between the length L of the fiber bundle and the trace length $L^t$ of the fiber bundle and the ratio ($L^t$/L) were calculated. Table 2 shows the results.

TABLE 2

| | Fiber bundle shape | L (mm) | $L^t$ (mm) | $L^t$ – L (mm) | $L^t$/L |
|---|---|---|---|---|---|
| Example 1 | Crimped | 6.78 | 7.89 | 1.11 | 1.16 |

REFERENCE SIGNS LIST

10 papermaking mat
11 one end
11*a* protrusion
12 another end
12*a* recess
20 inorganic fiber
21 fiber bundle
21*a* straight fiber bundle
21*b* crimped fiber bundle
22 inorganic fiber forming no fiber bundle
30 metal casing
40 exhaust gas treatment unit
40*a* exhaust gas inlet-side end
40*b* exhaust gas discharge-side end
41 cell
42 cell wall
43 plug
100 exhaust gas conversion apparatus

The invention claimed is:

1. A papermaking mat comprising:

inorganic fibers including inorganic fibers forming fiber bundles each formed from 10 or more of the inorganic fibers entangled and twisted together, and inorganic fibers forming no fiber bundles, wherein the fiber bundles have an average length of 5 to 15 mm, the fiber bundles have an average width of 0.2 to 1.0 mm, the fiber bundles include a crimped fiber bundle, and a trace length of the crimped fiber bundle as measured by a trace length measurement method described below is greater than a length of the crimped fiber bundle by 0.1 mm or more: trace length measurement method:

a crimped fiber bundle is placed still on a flat surface; and the crimped fiber bundle placed still is traced therealong from one end to another end thereof as viewed from above to determine a traced distance as "trace length of the crimped fiber bundle".

2. The papermaking mat according to claim 1, wherein the papermaking mat contains an organic binder in an amount of 0.1 to 20 parts by weight and an inorganic binder in an amount of 0.1 to 10 parts by weight per 100 parts by weight of the inorganic fibers.

3. The papermaking mat according to claim 2, wherein the organic binder has a glass transition temperature Tg of 5 °C or lower.

4. The papermaking mat according to claim 3, wherein the organic binder is at least one selected from the group consisting of: acrylic resins, acrylate latices, rubber latices, carboxymethyl cellulose and polyvinyl alcohol, all of which act as water-soluble organic polymers; styrene resins that act as a thermoplastic resin; and epoxy resins that act as a thermosetting resin.

5. The papermaking mat according to claim 3, wherein the inorganic binder contains at least one selected from the group consisting of alumina, silica, silicon carbide, zirconia, boron nitride, diamond, and pumice.

6. The papermaking mat according to claim 3, wherein the fiber bundles include a straight fiber bundle.

7. The papermaking mat according to claim 2, wherein the organic binder is at least one selected from the group consisting of: acrylic resins, acrylate latices, rubber latices, carboxymethyl cellulose and polyvinyl alcohol, all of which act as water-soluble organic polymers; styrene resins that act as a thermoplastic resin; and epoxy resins that act as a thermosetting resin.

8. The papermaking mat according to claim 7, wherein the inorganic binder contains at least one selected from the group consisting of alumina, silica, silicon carbide, zirconia, boron nitride, diamond, and pumice.

9. The papermaking mat according to claim 7, wherein the fiber bundles include a straight fiber bundle.

10. The papermaking mat according to claim 2, wherein the inorganic binder contains at least one selected from the group consisting of alumina, silica, silicon carbide, zirconia, boron nitride, diamond, and pumice.

11. The papermaking mat according to claim 10, wherein the fiber bundles include a straight fiber bundle.

12. The papermaking mat according to claim 2, wherein the fiber bundles include a straight fiber bundle.

13. The papermaking mat according to claim 1, wherein the fiber bundles include a straight fiber bundle.

* * * * *